US008800693B2

(12) United States Patent
DiGiovanni

(10) Patent No.: US 8,800,693 B2
(45) Date of Patent: Aug. 12, 2014

(54) POLYCRYSTALLINE COMPACTS INCLUDING NANOPARTICULATE INCLUSIONS, CUTTING ELEMENTS AND EARTH-BORING TOOLS INCLUDING SUCH COMPACTS, AND METHODS OF FORMING SAME

(75) Inventor: Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 416 days.

(21) Appl. No.: 13/226,127

(22) Filed: Sep. 6, 2011

(65) Prior Publication Data

US 2012/0111642 A1 May 10, 2012

Related U.S. Application Data

(60) Provisional application No. 61/411,355, filed on Nov. 8, 2010.

(51) Int. Cl.
*E21B 10/36* (2006.01)

(52) U.S. Cl.
USPC ..... 175/434; 175/433; 175/425; 175/420.2

(58) Field of Classification Search
CPC ..... E21B 10/55; E21B 2010/46; E21B 2010/545; E21B 2010/561
USPC ..... 175/433, 434, 425, 420.2
See application file for complete search history.

(56) References Cited

U.S. PATENT DOCUMENTS

| | | | | |
|---|---|---|---|---|
| 3,745,623 | A | 7/1973 | Wentorf, Jr. et al. | |
| 4,224,380 | A | 9/1980 | Bovenkerk et al. | |
| 4,231,195 | A * | 11/1980 | DeVries et al. | 51/307 |
| 4,610,699 | A | 9/1986 | Yazu et al. | |
| RE32,380 | E | 3/1987 | Wentorf, Jr. et al. | |
| 5,011,514 | A | 4/1991 | Cho et al. | |
| 5,096,465 | A | 3/1992 | Chen et al. | |
| 5,127,923 | A | 7/1992 | Bunting et al. | |
| 5,151,107 | A | 9/1992 | Cho et al. | |

(Continued)

FOREIGN PATENT DOCUMENTS

| | | | |
|---|---|---|---|
| WO | 2004078641 | A1 | 9/2004 |
| WO | 2006032982 | A1 | 3/2006 |

(Continued)

OTHER PUBLICATIONS

International Preliminary Report on Patentability for International Application No. PCT/US2011/050534 dated May 14, 2013, 6 pages.

(Continued)

*Primary Examiner* — Cathleen Hutchins
(74) *Attorney, Agent, or Firm* — TraskBritt

(57) ABSTRACT

Polycrystalline compacts include non-catalytic, non-carbide-forming particles in interstitial spaces between interbonded grains of hard material in a polycrystalline hard material. Cutting elements and earth-boring tools include such polycrystalline compacts. Methods of forming polycrystalline compacts include forming a polycrystalline material including a hard material and a plurality of particles comprising a non-catalytic, non-carbide-forming material. Methods of forming cutting elements include infiltrating interstitial spaces between interbonded grains of hard material in a polycrystalline material with a plurality of non-catalytic, non-carbide-forming particles.

25 Claims, 3 Drawing Sheets

(56) References Cited

U.S. PATENT DOCUMENTS

| | | | | |
|---|---|---|---|---|
| 5,205,684 | A | 4/1993 | Meskin et al. | |
| 5,370,195 | A | 12/1994 | Keshavan et al. | |
| 5,536,485 | A | 7/1996 | Kume et al. | |
| 5,954,147 | A | 9/1999 | Overstreet et al. | |
| 6,009,963 | A | 1/2000 | Chaves et al. | |
| 6,063,149 | A | 5/2000 | Zimmer | |
| 6,090,343 | A | 7/2000 | Kear et al. | |
| 6,194,481 | B1 | 2/2001 | Furman et al. | |
| 6,248,447 | B1 | 6/2001 | Griffin et al. | |
| 6,548,264 | B1 | 4/2003 | Tan et al. | |
| 6,852,414 | B1 | 2/2005 | Frushour | |
| 7,037,583 | B2 | 5/2006 | Furman et al. | |
| 7,060,641 | B2 | 6/2006 | Qian et al. | |
| 7,070,635 | B2 | 7/2006 | Frushour | |
| 7,309,526 | B2 | 12/2007 | Smith et al. | |
| 7,396,505 | B2 | 7/2008 | Pope et al. | |
| 7,397,558 | B2 | 7/2008 | Kamins et al. | |
| 7,493,973 | B2 | 2/2009 | Keshavan et al. | |
| 7,510,034 | B2 | 3/2009 | Curry et al. | |
| 7,516,804 | B2 | 4/2009 | Vail | |
| 7,527,860 | B2 | 5/2009 | Chih et al. | |
| 7,556,743 | B2 | 7/2009 | Furman et al. | |
| 7,635,035 | B1 | 12/2009 | Bertagnolli et al. | |
| 7,971,663 | B1 | 7/2011 | Vail | |
| 8,074,748 | B1 * | 12/2011 | Miess et al. | 175/374 |
| 2004/0238227 | A1 | 12/2004 | Smith et al. | |
| 2005/0019114 | A1 | 1/2005 | Sung | |
| 2005/0051366 | A1 | 3/2005 | Frushour | |
| 2005/0133277 | A1 | 6/2005 | Dixon | |
| 2005/0186104 | A1 | 8/2005 | Kear et al. | |
| 2006/0162969 | A1 | 7/2006 | Belnap et al. | |
| 2006/0191722 | A1 | 8/2006 | Belnap et al. | |
| 2007/0056778 | A1 | 3/2007 | Webb et al. | |
| 2007/0079994 | A1 | 4/2007 | Middlemiss | |
| 2007/0144790 | A1 | 6/2007 | Fang et al. | |
| 2007/0151769 | A1 | 7/2007 | Slutz et al. | |
| 2007/0187153 | A1 | 8/2007 | Bertagnolli | |
| 2007/0234646 | A1 | 10/2007 | Can et al. | |
| 2008/0023230 | A1 | 1/2008 | Cho | |
| 2008/0023231 | A1 | 1/2008 | Vail | |
| 2008/0073126 | A1 | 3/2008 | Shen et al. | |
| 2008/0073127 | A1 | 3/2008 | Zhan et al. | |
| 2008/0115424 | A1 | 5/2008 | Can et al. | |
| 2008/0127475 | A1 | 6/2008 | Griffo | |
| 2008/0168717 | A1 | 7/2008 | Can et al. | |
| 2008/0179104 | A1 | 7/2008 | Zhang et al. | |
| 2008/0206576 | A1 | 8/2008 | Qian et al. | |
| 2008/0209818 | A1 | 9/2008 | Belnap et al. | |
| 2008/0210473 | A1 | 9/2008 | Zhang et al. | |
| 2008/0282618 | A1 | 11/2008 | Lockwood et al. | |
| 2009/0071726 | A1 | 3/2009 | Belnap et al. | |
| 2009/0095538 | A1 | 4/2009 | Middlemiss | |
| 2009/0107291 | A1 | 4/2009 | Levashov et al. | |
| 2009/0152015 | A1 | 6/2009 | Sani et al. | |
| 2010/0213247 | A1 * | 8/2010 | Egan et al. | 228/220 |
| 2010/0243335 | A1 | 9/2010 | Dourfaye et al. | |
| 2010/0294571 | A1 | 11/2010 | Belnap et al. | |
| 2011/0023375 | A1 | 2/2011 | Sani et al. | |
| 2011/0023377 | A1 | 2/2011 | DiGiovanni | |
| 2011/0031034 | A1 | 2/2011 | DiGiovanni et al. | |
| 2011/0031037 | A1 | 2/2011 | Bellin et al. | |
| 2011/0036643 | A1 | 2/2011 | Belnap et al. | |
| 2011/0061942 | A1 | 3/2011 | DiGiovanni | |
| 2011/0088954 | A1 | 4/2011 | DiGiovanni et al. | |
| 2011/0214921 | A1 | 9/2011 | Naidoo | |
| 2012/0037431 | A1 | 2/2012 | DiGiovanni et al. | |

FOREIGN PATENT DOCUMENTS

| | | | |
|---|---|---|---|
| WO | 2006032984 | A2 | 3/2006 |
| WO | 2006032984 | A3 | 3/2006 |
| WO | 2007035394 | A2 | 3/2007 |
| WO | 2007088461 | A1 | 8/2007 |
| WO | 2007110770 | A2 | 10/2007 |
| WO | 2007144731 | A2 | 12/2007 |
| WO | 2007144731 | A3 | 12/2007 |
| WO | 2007144733 | A2 | 12/2007 |
| WO | 2007148214 | A3 | 12/2007 |
| WO | 2007149266 | A1 | 12/2007 |
| WO | 2008053431 | A1 | 5/2008 |
| WO | 2008096314 | A2 | 8/2008 |
| WO | 2008094190 | A2 | 9/2008 |
| WO | 2008114228 | A1 | 9/2008 |
| WO | 2009132035 | A1 | 10/2009 |

OTHER PUBLICATIONS

DiGiovanni et al, U.S. Appl. No. 61/232,265, entitled Polycrystalline Compacts Including In Situ Nucleated Grains, Earth Boring Tools Including Such Compacts, and Methods of Forming Such Compacts and Tools, filed on Aug. 7, 2009.

DiGiovanni et al, U.S. Appl. No. 61/373,617, filed Aug. 13, 2010 and entitled "Cutting Elements Including Nanoparticles in At Least One Portion Thereof, Earth Boring Tools Including Such Cutting Elements, and Related Methods,".

U.S. Appl. No. 61/324,142, filed Apr. 14, 2010 and entitled Method of Preparing Polycrystalline Diamond from Derivatized Nanodiamond.

Furman et al., Structural and Mechanical Behavior of Layered Zirconium Phosphonate as a Distributed Phase in Polycaprolactone, Journal of Applied Polymer Science, vol. 114, pp. 993-1001, 2009.

Arima, Makoto, et al., "Diamond nucleation and growth by reduction of carbonate melts under high-pressure and high-temperature conditions," Geology, vol. 30, No. 8, pp. 691-694, Aug. 2002.

Athanassiou, E.K., et al., "Large-scale production of carbon-coated copper nanoparticles for sensor applications," Nanotechnology, vol. 17, pp. 1668-1673, 2006.

Banhart, F., et al., "Carbon onions as nanoscopic pressure cells for diamond formation," Nature, vol. 382, pp. 433-435, Aug. 1, 1996.

Berger, Michael, "A green synthesis technique for fabricating carbon-coated magnetic nanoparticles," 2 pages, posted Aug. 15, 2006, copyright 2006 Nanowerk LLC.

Beulens, J.J., et al., "Diamond, Graphite, and Amorphous Carbon Deposition," Le Vide, Les Couches Minces—Supplement No. 256, pp. 329-331, Mar.-Apr. 1991.

Dahl, J.E., et al., "Isolation and Structure of Higher Diamondoids, Nanometer-Sized Diamond Molecules," Science, vol. 299, pp. 96-99, Jan. 3, 2003.

Fangli, Yuan, et al., "Preparation of zinc oxide nano-particles coated with aluminum," Journal of Materials Science Letters, vol. 20, pp. 1549-1551, 2001.

Ghiringhelli, L.M., et al., "Local Structure of Liquid Carbon Controls Diamond Nucleation," Physical Review Letters, vol. 99, No. 5, pp. 055702-1 through 055702-4, Aug. 3, 2007.

Giber, J., et al., "Critical Point Energies in hcp and fcc Cobalt from Appearance Potential Spectra," Appl. Phys. A., vol. 52, pp. 167-170, 1991.

Itoh, M., et al., "Amorphous carbon nitride film preparation by plasma-assisted pulsed laser deposition method," Appl. Phys. A, vol. 79, pp. 1575-1578, 2004.

Kidalov, S.V., et al., "Thermal conductivity of nanocomposites based on diamonds and nanodiamonds," Diamond & Related Materials, vol. 16, pp. 2063-2066, 2007.

Li, Junjie, et al., "Field emission enhancement of amorphous carbon films by nitrogen-implantation," Carbon, vol. 42, pp. 2309-2314, 2004.

Li, Q.Y., et al., "Photocatalytic characterization of silica coated titania nanoparticles with tunable coatings," Journal of Nanoparticle Research, vol. 7, pp. 295-299, 2005.

Liu, Huimin, et al., "Diamond Chemical Vapor Deposition, Nucleation and Early Growth Stages," Dept. of Chemical and Vioresource Engineering, Colorado State University, ISBN 0-8155-1380-1, Noyes Publications, 198 pages, 1995.

Liu, Huimin, et al., "Nucleation Kinetics of Diamond on Carbide-Forming Substrates during Chemical Vapor Deposition," J. Electrochem. Soc., vol. 143, No. 3, pp. 1104-1109, Mar. 1996.

(56) References Cited

OTHER PUBLICATIONS

Liu, Huimin, et al., "Studies on nucleation process in diamond CVD: an overview of recent developments," Diamond and Related Materials, vol. 4, pp. 1173-1188, 1995.
Majetich, S.A., et al., "Preparation and properties of carbon-coated magnetic nanocrystallites," Phys. Rev. B, vol. 48, pp. 16845-16848, 1993.
Meilunas, R.J., et al., "Diamond Nucleation on Surfaces Using Carbon Clusters," Office of Naval Research, Technical Report No. 12, Dept. of Materials Science and Engineering, Northwestern University, prepared for publication in the Journal of Materials Research, 61 pages, May 1993.
Osipov, A.S., et al., "Rapid sintering of nano-diamond compacts," Diamond & Related Materials, 4 pages, 2009.
Qian, J., et al., "Graphitization of diamond powders of different sizes at high pressure-high temperature," Carbon, vol. 42, pp. 2691-2697, 2004.
Qian, J., et al., "Micron diamond composites with nanocrystalline silicon carbide bonding," J. Mater. Res., vol. 18, No. 5, pp. 1173-1178, May 2003.
Sadangi, Rajendra K., et al., "WC-Co-Diamond Nano-Composites," NanoStructured Materials, vol. 12, pp. 1031-1034, 1999.
Schmidt, S., et al., "Watching the Growth of Bulk Grains During Recrystallization of Deformed Metals," Science, vol. 305, pp. 229-232, Jul. 9, 2004.
Sumiya, Hitoshi, et al., "Synthesis of High-Purity Nano-Polycrystalline Diamond and Its Characterization," SEI Technical Review, No. 59, pp. 52-59, Jan. 2005.
Wang, Guangzu, et al., "Effect of Recrystallized Graphite on the Nucleation of Diamond in Film Growth Reactions," Science and Technology of New Diamond, pp. 257-259, 1990.
Wei, Xian-Wen, et al., "A solution phase fabrication of magnetic nanoparticles encapsulated in carbon," Nanotechnology, vol. 17, pp. 4307-4311, 2006.
Welz, Sascha, et al., "Nucleation, growth, and graphitization of diamond nanocrystals during chlorination of carbides," Journal of Applied Physics, vol. 93, No. 7, pp. 4207-4214, Apr. 1, 2003.
Wheeler, N.S., "Microstructural Characterization of Cobalt-Tungsten Coated Graphite Fibers," J. Res. Natl. Inst. Stand. Technol., vol. 100, No. 6, pp. 641-659, Nov.-Dec. 1995.
Wu, B.Y.C., et al., "Nanostructured Ni-Co Alloys with Tailorable Grain Size and Twin Density," Metallurgical and Materials Transactions A, vol. 36A, pp. 1927-1936, Jul. 2005.
Yanchuk, I.B., et al., "Raman scattering, AFM and nanoindentation characterization of diamond films obtained by hot filament CVD," Diamond and Related Materials, vol. 12, pp. 266-269, 2004.
Yushin, G.N., et al., "Effect of sintering on structure of nanodiamond," Diamond and Related Materials, vol. 14, pp. 1721-1729, 2005.
Zhang, L., et al., "Ultrafine and nanoscaled tungsten carbide synthesis from colloidal carbon coated nano tungsten precursor," Powder Metallurgy, vol. 49, No. 4, pp. 369-373, 2006.
Zhao, Y., et al., "Superhard B-C-N materials synthesized in nanostructured bulks," J. Mater. Res., vol. 17, No. 12, pp. 3139-3145, Dec. 2002.
International Search Report for International Application No. PCT/US2011/050534 mailed Mar. 16, 2012, 3 pages.
International Written Opinion for International Application No. PCT/US2011/050534 mailed Mar. 16, 2012, 5 pages.

* cited by examiner

POLYCRYSTALLINE COMPACTS INCLUDING NANOPARTICULATE INCLUSIONS, CUTTING ELEMENTS AND EARTH-BORING TOOLS INCLUDING SUCH COMPACTS, AND METHODS OF FORMING SAME

CROSS-REFERENCE TO RELATED APPLICATION

This application claims the benefit of U.S. Provisional Patent Application Ser. No. 61/411,355, filed Nov. 8, 2010, entitled "Polycrystalline Compacts Including Nanoparticulate Inclusions, Cutting Elements and Earth-Boring Tools Including Such Compacts, and Methods of Forming Same," the disclosure of which is incorporated herein by reference in its entirety.

TECHNICAL FIELD

The present disclosure relates generally to polycrystalline compacts, which may be used, for example, as cutting elements for earth-boring tools, and to methods of forming such polycrystalline compacts, cutting elements, and earth-boring tools.

BACKGROUND

Earth-boring tools for forming wellbores in subterranean earth formations generally include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit. In other words, earth-boring tools typically include a bit body to which cutting elements are attached.

The cutting elements used in such earth-boring tools often include polycrystalline diamond compacts (often referred to as "PDC"), which comprise a polycrystalline diamond material. Polycrystalline diamond material is material that includes interbonded grains or crystals of diamond material. In other words, polycrystalline diamond material includes direct, inter-granular bonds between the grains or crystals of diamond material. The terms "grain" and "crystal" are used synonymously and interchangeably herein.

Polycrystalline diamond compact cutting elements are typically formed by sintering and bonding together relatively small diamond grains under conditions of high temperature and high pressure in the presence of a catalyst (e.g., cobalt, iron, nickel, or alloys and mixtures thereof) to form a layer (e.g., a compact or "table") of polycrystalline diamond material on a cutting element substrate. These processes are often referred to as high temperature/high pressure (HTHP) processes. The cutting element substrate may comprise a cermet material (i.e., a ceramic-metal composite material) such as, for example, cobalt-cemented tungsten carbide. In such instances, the cobalt (or other catalyst material) in the cutting element substrate may be swept into the diamond grains during sintering and serve as the catalyst material for forming the inter-granular diamond-to-diamond bonds, and the resulting diamond table, from the diamond grains. In other methods, powdered catalyst material may be mixed with the diamond grains prior to sintering the grains together in an HTHP process.

Upon formation of a diamond table using an HTHP process, catalyst material may remain in interstitial spaces between the grains of diamond in the resulting polycrystalline diamond compact. The presence of the catalyst material in the diamond table may contribute to thermal damage in the diamond table when the cutting element is heated during use, due to friction at the contact point between the cutting element and the formation.

Polycrystalline diamond compact cutting elements in which the catalyst material remains in the polycrystalline diamond compact are generally thermally stable up to a temperature of about seven hundred fifty degrees Celsius (750° C.), although internal stress within the cutting element may begin to develop at temperatures exceeding about three hundred fifty degrees Celsius (350° C.). This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about seven hundred fifty degrees Celsius (750° C.) and above, stresses within the diamond table itself may increase significantly due to differences in the coefficients of thermal expansion of the diamond material and the catalyst material within the diamond table. For example, cobalt thermally expands significantly faster than diamond, which may cause cracks to form and propagate within the diamond table, eventually leading to deterioration of the diamond table and ineffectiveness of the cutting element.

Furthermore, at temperatures at or above about seven hundred fifty degrees Celsius (750° C.), some of the diamond crystals within the polycrystalline diamond compact may react with the catalyst material causing the diamond crystals to undergo a chemical breakdown or back-conversion to another allotrope of carbon or another carbon-based material. For example, the diamond crystals may graphitize at the diamond crystal boundaries, which may substantially weaken the diamond table. In addition, at extremely high temperatures, in addition to graphite, some of the diamond crystals may be converted to carbon monoxide and carbon dioxide.

In order to reduce the problems associated with differential rates of thermal expansion and chemical breakdown of the diamond crystals in polycrystalline diamond compact cutting elements, so-called "thermally stable" polycrystalline diamond compacts (which are also known as thermally stable products, or "TSPs") have been developed. Such a thermally stable polycrystalline diamond compact may be formed by leaching the catalyst material (e.g., cobalt) out from interstitial spaces between the interbonded diamond crystals in the diamond table using, for example, an acid or combination of acids (e.g., aqua regia). Substantially all of the catalyst material may be removed from the diamond table, or catalyst material may be removed from only a portion thereof. Thermally stable polycrystalline diamond compacts in which substantially all catalyst material has been leached out from the diamond table have been reported to be thermally stable up to temperatures of about twelve hundred degrees Celsius (1,200° C.). It has also been reported, however, that such fully leached diamond tables are relatively more brittle and vulnerable to shear, compressive, and tensile stresses than are non-leached diamond tables. In addition, it is difficult to secure a completely leached diamond table to a supporting substrate.

In an effort to provide cutting elements having polycrystalline diamond compacts that are more thermally stable relative to non-leached polycrystalline diamond compacts, but that are also relatively less brittle and vulnerable to shear, compressive, and tensile stresses relative to fully leached diamond tables, cutting elements have been provided that include a diamond table in which the catalyst material has been leached from a portion or portions of the diamond table. For example, it is known to leach catalyst material from a cutting face, from the side of the diamond table, or both, to a desired depth within the diamond table, but without leaching all of the catalyst material out from the diamond table.

BRIEF SUMMARY

In some embodiments, the present disclosure includes polycrystalline compacts that comprise a plurality of grains of hard material that are interbonded to form a polycrystalline hard material, and a plurality of particles disposed in interstitial spaces between the grains of hard material, the particles (e.g., nanoparticles) comprising a non-catalytic, non-carbide-forming metal. In some embodiments, the particles may comprise rhenium.

In additional embodiments, the present disclosure includes cutting elements and drill bits comprising at least one such polycrystalline compact.

In further embodiments, the present disclosure includes methods of forming polycrystalline compacts. The methods including forming a polycrystalline material including a hard material comprising a plurality of hard particles and a plurality of particles comprising a non-catalytic, non-carbide-forming material disposed in a plurality of interstitial spaces between a plurality of interbonded grains of the hard material.

In yet further embodiments, the present disclosure includes methods of forming polycrystalline compacts, in which a plurality of hard particles and a plurality of non-catalytic, non-carbide-forming particles (e.g., nanoparticles) are sintered to form a polycrystalline hard material comprising a plurality of interbonded grains of hard material.

In additional embodiments, the present disclosure includes methods of forming cutting elements in which interstitial spaces between interbonded grains of hard material in a polycrystalline material are infiltrated with a plurality of non-catalytic, non-carbide-forming particles (e.g., nanoparticles).

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of some embodiments of the disclosure when read in conjunction with the accompanying drawings, in which:

DETAILED DESCRIPTION

Figure 1A:
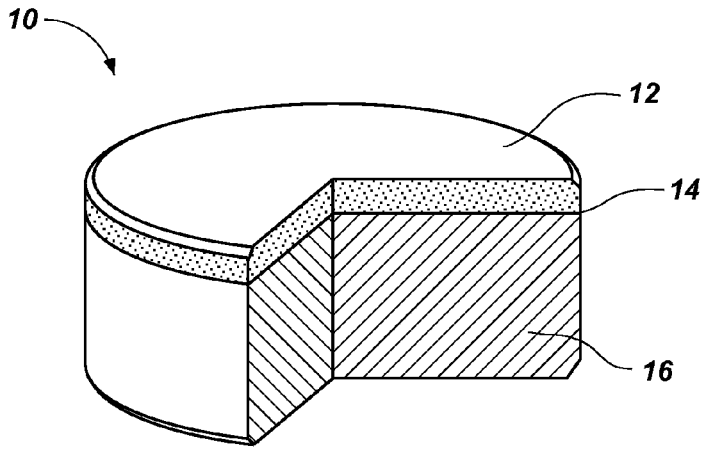
FIG. 1A is a partial cut-away perspective view illustrating an embodiment of a cutting element comprising a polycrystalline compact of the present disclosure.

The illustrations presented herein are not actual views of any particular polycrystalline compact, microstructure of a polycrystalline compact, particle, cutting element, or drill bit, and are not drawn to scale, but are merely idealized representations employed to describe the present disclosure. Additionally, elements common between figures may retain the same numerical designation.

As used herein, the term "drill bit" means and includes any type of bit or tool used for drilling during the formation or enlargement of a wellbore and includes, for example, rotary drill bits, percussion bits, core bits, eccentric bits, bi-center bits, reamers, mills, drag bits, roller cone bits, hybrid bits and other drilling bits and tools known in the art.

As used herein, the term "nanoparticle" means and includes any particle or grain of material having an average particle diameter of about 500 nm or less. Nanoparticles include grains in a polycrystalline material having an average grain size of about 500 nm or less.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

As used herein, the term "inter-granular bond" means and includes any direct atomic bond (e.g., covalent, metallic, etc.) between atoms in adjacent grains of material.

As used herein, the term "catalyst material" refers to any material that is capable of substantially catalyzing the formation of inter-granular bonds between grains of hard material during a sintering process (e.g., an HTHP process). For example, catalyst materials for diamond include cobalt, iron, nickel, other elements from Group VIIIA of the Periodic Table of the Elements, and alloys thereof.

As used herein, the term "non-catalytic material" refers to any material that is at least substantially not a catalyst material.

As used herein, the term "hard material" means and includes any material or particles thereof having a Knoop hardness value of about 2,000 $Kg_f/mm^2$ (20 GPa) or more. In some embodiments, the hard materials employed herein may have a Knoop hardness value of about 3,000 $Kg_f/mm^2$ (29.4 GPa) or more. Such materials include, for example, diamond and cubic boron nitride.

As used herein, the term "non-catalytic, non-carbide-forming nanoparticle" means and includes any nanoparticle that is not comprised of a catalyst material, diamond, or cubic boron nitride, and that is at least substantially unreactive with carbon at conditions commonly achieved during formation and use of a polycrystalline table. Substantially non-catalytic, non-carbide-forming nanoparticles, in some embodiments, may comprise refractory metals and alloys thereof as described in greater detail below. In some embodiments, the non-catalytic, non-carbide-forming nanoparticles may also be at least substantially unreactive with a catalyst material.

FIG. 1A is a simplified, partially cut-away perspective view of an embodiment of a cutting element 10 of the present disclosure. The cutting element 10 comprises a polycrystalline compact in the form of a layer of hard polycrystalline material 12, also known in the art as a polycrystalline table, that is provided on (e.g., formed on or attached to) a supporting substrate 16 with an interface 14 therebetween. Though the cutting element 10 in the embodiment depicted in FIG. 1A is cylindrical or disc-shaped, in other embodiments, the cutting element 10 may have any desirable shape, such as a dome, cone, chisel, etc.

In some embodiments, the polycrystalline material 12 comprises polycrystalline diamond. In such embodiments, the cutting element 10 may be referred to as a polycrystalline diamond compact (PDC) cutting element. In other embodiments, the polycrystalline material 12 may comprise another hard material such as, for example, polycrystalline cubic boron nitride.

Figure 1B:
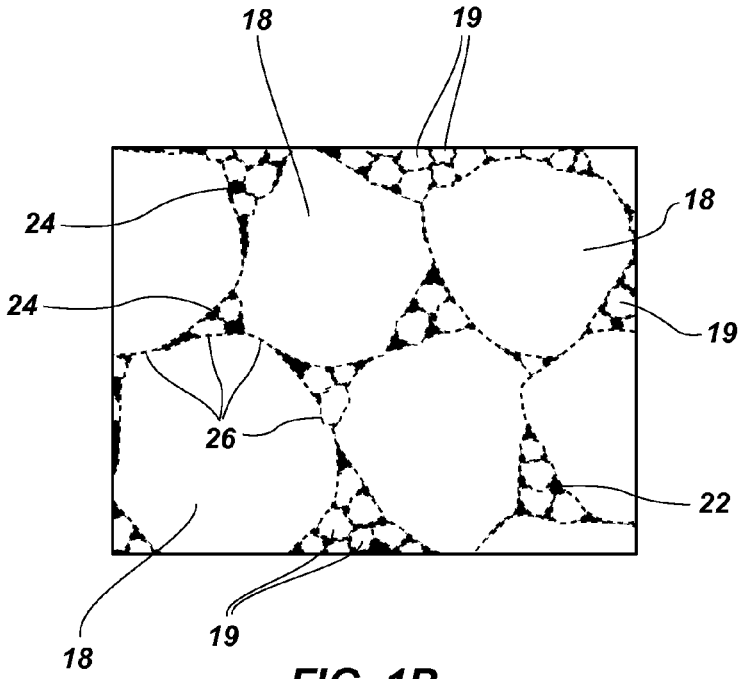
FIG. 1B is a simplified drawing showing how a microstructure of the polycrystalline compact of FIG. 1A may appear under magnification, and illustrates interbonded and interspersed larger and smaller grains of hard material.

FIG. 1B is an enlarged view illustrating how a microstructure of the polycrystalline material 12 of the cutting element 10 may appear under magnification. As discussed in further detail below, the polycrystalline material 12 includes interbonded grains 18 of hard material. The polycrystalline material 12 also includes particles 19 (e.g., nanoparticles) disposed in interstitial spaces between the interbonded grains 18 of hard material. These particles 19 in the polycrystalline material 12 may reduce an amount of catalyst material remaining in the polycrystalline material 12 as a catalyst material is used to catalyze formation of the polycrystalline material 12 in a sintering process, such as a high temperature, high pressure (HTHP) process. In other words, at least substantially non-catalytic, non-carbide-forming particulate inclusions (i.e., particles 19) may be incorporated into the polycrystalline material 12 such that the amount of catalyst material remaining in interstitial spaces between the interbonded grains 18 of hard material in the microstructure after the sintering process is reduced by volumetric exclusion based on the presence of the non-catalyst, non-carbide-forming particles 19. The spatial volume occupied by these particles 19 cannot be occupied by catalyst material, and, hence, the amount of catalyst material in the polycrystalline material 12 is reduced. The overall reduction of catalytic material in the grain boundary regions between the interbonded grains 18 of hard material may lead to an increase in thermal stability of the cutting element 10 by having a reduced coefficient of thermal expansion mismatch effect from the reduced content of catalyst material. Furthermore, in embodiments in which the hard material comprises diamond, the reduction of catalytic material in between the interbonded grains 18 of hard material may also decrease the susceptibility of the diamond to graphitize (often referred to as "reverse graphitization") for substantially the same reasons.

The particles 19 in the polycrystalline material 12 may also lower an overall thermal conductivity of the polycrystalline material 12. In other words, the particulate inclusions (i.e., particles 19) may have a lower thermal conductivity than at least the interbonded grains 18 of hard material such that the overall thermal conductivity of the polycrystalline material 12 is reduced.

The overall reduction of thermal conductivity in the polycrystalline material 12 may lead to an increase in thermal stability of the cutting element 10. The particles 19 having a low thermal conductivity may act to insulate or slow the distribution of heat to at least a portion of the polycrystalline material 12. For example, during drilling of an earth formation, a temperature of an exterior of the polycrystalline material 12 may increase due to frictional forces between the polycrystalline material 12 and the earth formation. Because of the reduced overall thermal conductivity of the polycrystalline material 12, the increased temperature may be at least partially contained to the exterior of the polycrystalline material 12. This may help to maintain an interior portion of the polycrystalline material 12 at a lower and more stable temperature. Accordingly, by insulating at least a portion of the polycrystalline material 12, the insulated portion of the polycrystalline material maybe relatively less likely to degrade during use due to thermal expansion mismatch between the different elements within the polycrystalline material. Furthermore, in embodiments in which the hard material comprises diamond, the reduction of heat transferred to at least a portion of the polycrystalline material may also decrease the susceptibility of the diamond to graphitize (often referred to as "reverse graphitization").

In some embodiments, the grains 18 of hard material in the polycrystalline material 12 may have a uniform, mono-modal grain size distribution, as shown in FIG. 1B.

In additional embodiments, the grains 18 of the polycrystalline material 12 may have a multi-modal (e.g., bi-modal, tri-modal, etc.) grain size distribution. For example, the polycrystalline material 12 may comprise a multi-modal grain size distribution as disclosed in at least one of Provisional U.S. Patent Application Ser. No. 61/232,265, which was filed on Aug. 7, 2009, and entitled "Polycrystalline Compacts Including In-Situ Nucleated Grains, Earth-Boring Tools Including Such Compacts, and Methods Of Forming Such Compacts and Tools," and U.S. patent application Ser. No. 12/558,184, which was filed on Sep. 11, 2009, and entitled "Polycrystalline Compacts Having Material Disposed In Interstitial Spaces Therein, Cutting Elements And Earth-Boring Tools Including Such Compacts, and Methods Of Forming Such Compacts," the disclosure of each of which is incorporated herein in its entirety by this reference.

As known in the art, the average grain size of grains within a microstructure may be determined by measuring grains of the microstructure under magnification. For example, a scanning electron microscope (SEM), a field emission scanning electron microscope (FESEM), or a transmission electron microscope (TEM) may be used to view or image a surface of a polycrystalline material 12 (e.g., a polished and etched surface of the polycrystalline material 12). Commercially available vision systems are often used with such microscopy systems, and these vision systems are capable of measuring the average grain size of grains within a microstructure.

In some embodiments, at least some of the grains 18 of hard material may comprise in-situ nucleated grains 18 of hard material, as disclosed in the aforementioned provisional U.S. Patent Application Ser. No. 61/232,265, which was filed on Aug. 7, 2009.

The interstitial spaces 22 between the grains 18 of hard material may be at least partially filled with non-catalytic, non-carbide-forming particles 19 (e.g., nanoparticles) and with a catalyst material 24.

The particles 19 disposed in the interstitial spaces between the interbonded grains 18 of hard material may comprise a non-catalytic, non-carbide-forming material. The non-catalytic, non-carbide-forming material of the particles 19 may comprise, for example, a refractory metal. As particular non-limiting examples, the non-catalytic, non-carbide-forming particles 19 may comprise at least one of rhenium, osmium, ruthenium, rhodium, iridium, platinum, molybdenum, and alloys thereof.

In additional embodiments, the material of the non-catalytic, non-carbide-forming particles 19 may be selected such that at least a portion of the particles 19 do not react with the catalyst material 24 or may only form in a solid solution between the materials. For example, in one embodiment, the particles 19 may comprise at least one of rhenium, platinum, and ruthenium, and the catalyst material 24 may comprise cobalt. Rhenium, for example, is believed to be at least substantially unreactive with cobalt at temperatures, pressures, and durations of sintering processes used in the formation of the polycrystalline material 12 as described in greater detail below.

Because at least a portion of the particles 19 may not react with the catalyst material 24 or may only form a solid solution, the particles 19 may help to lower an overall thermal conductivity of the polycrystalline material 12. For example, the particles 19 may have a thermal conductivity less than a thermal conductivity of the catalyst material 24. In some embodiments, the particles 19 may have a thermal conductivity of about three quarters or less of a thermal conductivity of the catalyst material 24. For example, in one embodiment, the particles 19 may comprise rhenium which has a thermal conductivity of about forty-eight watts per meter-Kelvin (48 $Wm^{-1}K^{-1}$) and the catalyst material 24 may comprise cobalt which has a thermal conductivity of about one hundred watts per meter-Kelvin (100 $Wm^{-1}K^{-1}$). Additionally, because at least a portion of the particles 19 may not react with the catalyst material 24, the particles 19 may help to reduce the variations in linear coefficients of thermal expansion throughout the polycrystalline material. For example, the particles 19 may have a linear coefficient of thermal expansion less than a linear coefficient of thermal expansion of the catalyst material 24. In some embodiments, the particles 19 may have a linear coefficient of thermal expansion of about one-half or less of the linear coefficient of thermal expansion of the catalyst material 24. For example, in one embodiment, the particles 19 may comprise rhenium which has a linear coefficient of thermal expansion of about $6.2\times10^{-6}$ $K^{-1}$ and the catalyst material 24 may comprise cobalt which has a linear coefficient of thermal expansion of about $13.0\times10^{-6}$ $K^{-1}$. In some embodiments, material of the particles 19 may have a zero or negative linear coefficient of thermal expansion. In other words, material of the particles 19 may be selected to exhibit substantially no expansion or contraction when subjected to heating. For example, the particles 19 may comprise zirconium tungstate that exhibits a negative linear coefficient of thermal expansion.

Figure 2:
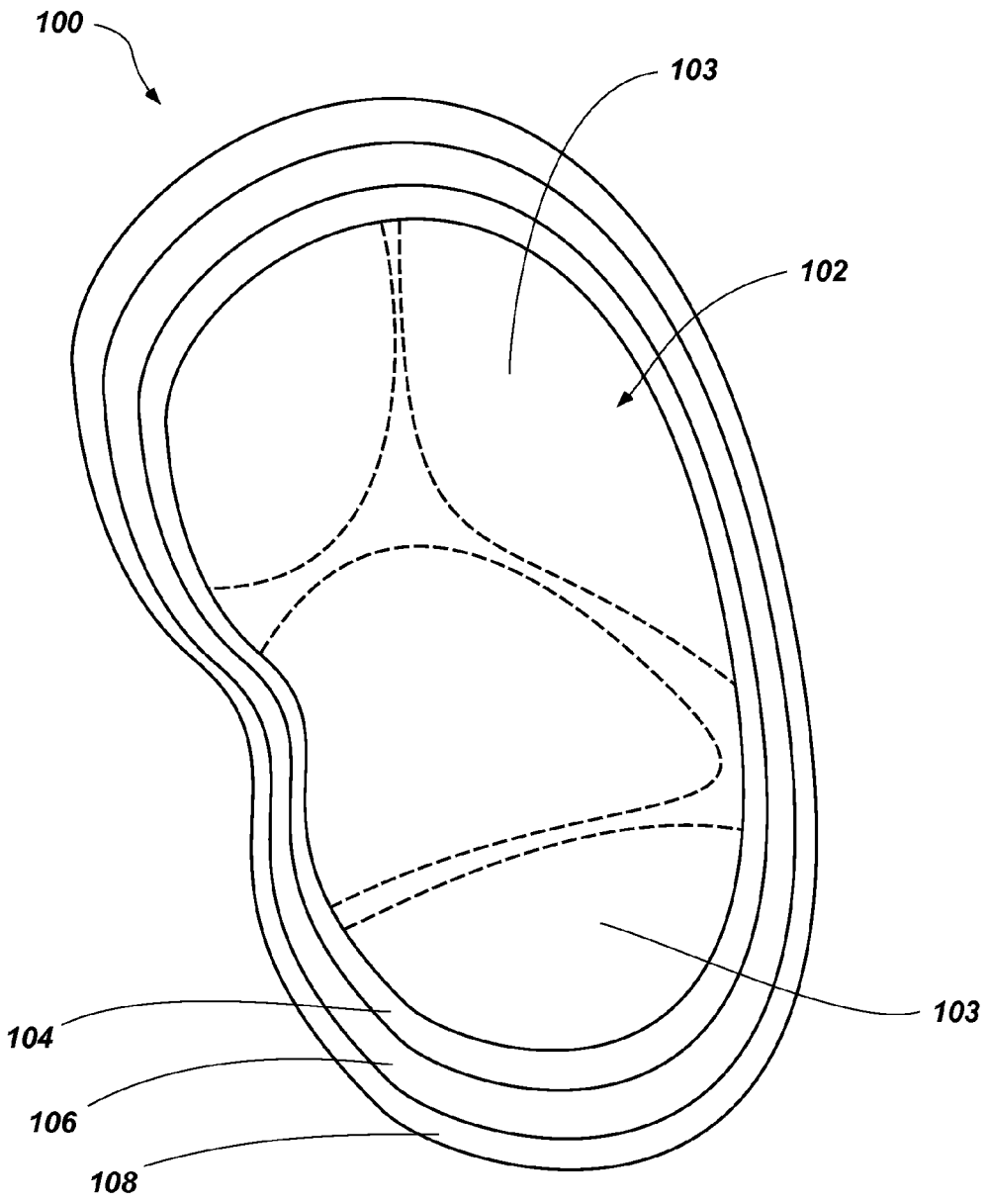
FIG. 2 includes an enlarged view of one embodiment of a non-catalytic, non-carbide-forming nanoparticle of the present disclosure.

In some embodiments, the non-catalytic, non-carbide-forming particles 19 may, at least initially (prior to a sintering process used to form the polycrystalline material 12), comprise at least two materials, as does the particle 100 illustrated in FIG. 2. In some embodiments, the particle 100 may comprise a nanoparticle. For example, the particle 100 may include a core 102 comprising a first material and one or more coatings 104, 106, 108 comprising at least one other material. For example, at least one of the core 102 and the one or more coatings 104, 106, 108 comprises a non-catalytic, non-carbide-forming material while another portion of the particle comprised another material (e.g., an oxide, a carbide, a refractory metal, a catalytic metal, an alloy, a cermet, a ceramic, a clay, a mineral, a fullerene, a carbon nanotube (CNT), a graphene, combinations thereof, etc.). In some embodiments, the core 102 may comprise the catalyst material 24. In some embodiments, at least one coating 104, 106, 108 may comprise the catalyst material 24 while at least one other coating 104, 106, 108 comprises a non-catalytic, non-carbide-forming material.

The core 102 may comprise a single nanoparticle or the core may comprise a plurality or cluster of smaller nanoparticles 103. The core 102, comprising one particle or a plurality of particles 103, may have a total average particle size of between about twenty-five nanometers (25 nm) and about seventy-five nanometers (75 nm). For example, in one embodiment, the core 102 may comprise a single particle of cobalt having an average particle size of about twenty-five nanometers (25 nm). In another embodiment, the core 102 may comprise a plurality of nanoparticles 103 having an average particle size of about two nanometers (2 nm) to about ten nanometers (10 nm) which have agglomerated to form the core 102 having an average particle size of about fifty nanometers (50 nm) to about seventy-five nanometers (75 nm). The plurality of nanoparticles 103 may have a uniform average particle size or the plurality of nanoparticles 103 may have differing average particle sizes. In yet further embodiments, the plurality of nanoparticles 103 forming the core 102 may comprise at least two materials. For example, in one embodiment, at least one nanoparticle of the plurality of nanoparticles 103 may comprise cobalt and at least one nanoparticle of the plurality of nanoparticles 103 may comprise a non-catalytic, non-carbide-forming material such as rhenium, platinum, osmium, or an alloy or mixture thereof.

In some embodiments, the one or more coatings 104, 106, 108 of the particles 100 may comprise rhenium. For example, the particles 100 may comprise a core 102 comprising one or more nanoparticles 103 of diamond and one or more coatings 104, 106, 108 comprising rhenium. By way of further example, the particles 100 may comprise a core 102 comprising one or more nanoparticles 103 of zirconium tungstate and one or more coatings 104, 106, 108 comprising rhenium. By way of yet further example, the particles 100 may comprise a core 102 comprising one or more nanoparticles 103 of scandium tungstate and one or more coatings 104, 106, 108 comprising rhenium.

In additional embodiments, the one or more coatings 104, 106, 108 of the particles 100 may comprise molybdenum. For example, the particles 100 may comprise a core 102 comprising one or more nanoparticles 103 of diamond and one or more coatings 104, 106, 108 comprising molybdenum. By way of further example, the particles 100 may comprise a core 102 comprising one or more nanoparticles 103 of zirconium tungstate and one or more coatings 104, 106, 108 comprising molybdenum.

Each coating of the one or more coatings 104, 106, 108 may have a thickness of between about two nanometers (2 nm) and about five nanometers (5 nm). In some embodiments each of the at least one coating 105, 106, 108 may be conformally deposited on the core 102. In some embodiments, multiple coatings of the same material may be formed over the core 102. For example, a first coating 104, a second coating 106, and a third coating 108 each comprising rhenium may be formed over the core 102. In alternative embodiments, at least two coatings 104, 106, 108 comprising different materials may be formed on the core 102. For example, in one embodiment the first coating 104 comprising rhenium may be formed over the core 102, the second coating 106 comprising platinum may be foamed over the first coating 104, and the third coating 108 comprising rhenium may be formed over the second coating 106. While FIG. 2 is illustrated as having three coatings 104, 106, 108 over the core 102, it is understood that any number of coatings may be applied to the core 102 such that the total particle comprises a nanoparticle. In further embodiments, micron sized clusters formed of at least two nanoparticles, like the particle 100 of FIG. 2, may be conglomerated and coated either individually or in combination and incorporated into the polycrystalline material 12.

By way of example and not limitation, processes (e.g., nanoencapsulation process) such as liquid sol-gel, flame spray pyrolysis, chemical vapor deposition (CVD), physical vapor deposition (PVD) (e.g., sputtering), and atomic layer deposition (ALD), may be used to provide the one or more coatings 104, 106, 108 on the core 102. Other techniques that may be used to provide the at least one coating 105, 106, 108 on the core 102 include colloidal coating processes, plasma coating processes, microwave plasma coating processes, physical admixture processes, van der Waals coating processes, and electrophoretic coating processes. In some embodiments, the one or more coatings 104, 106, 108 may be provided on the core 102 in a fluidized bed reactor.

Referring again to FIGS. 1A and 1B, the volume occupied by the particles 19 in the polycrystalline material 12 may be in a range extending from about 0.01% to about 50% of the volume of the polycrystalline material 12. The weight percentage of the particles 19 in the polycrystalline material 12 may be in a range extending from about 0.1% to about 10% by weight.

In some embodiments, as least some of the non-catalytic, non-carbide-forming particles 19 may be bonded to the grains 18 of hard material after the sintering process (e.g., an HPHT process) used to form the polycrystalline material 12.

In some embodiments, the polycrystalline material 12 may also include the catalyst material 24 disposed in interstitial spaces 22 between the interbonded grains 18 of the polycrystalline hard material and between the particles 19. The catalyst material 24 may comprise a catalyst used to catalyze the formation of the inter-granular bonds 26 between the grains 18 of hard material in the polycrystalline material 12. In other embodiments, however, the interstitial spaces 22 between the grains 18 and the particles 19 in some or all regions of the polycrystalline material 12 may be at least substantially free of such a catalyst material 24. In such embodiments, the interstitial spaces 22 may comprise voids filled with gas (e.g., air).

In embodiments in which the polycrystalline material 12 comprises polycrystalline diamond, the catalyst material 24 may comprise a Group VIIIA element (e.g., iron, cobalt, or nickel) or an alloy thereof, and the catalyst material 24 may comprise between about one half of one percent (0.1%) and about ten percent (10%) by volume of the hard polycrystalline material 12. In additional embodiments, the catalyst material 24 may comprise a carbonate material such as, for example, a carbonate of one or more of magnesium, calcium, strontium, and barium. Carbonates may also be used to catalyze the formation of polycrystalline diamond.

The layer of hard polycrystalline material 12 of the cutting element 10 may be formed using a high temperature/high pressure (HTHP) process. Such processes, and systems for carrying out such processes, are generally known in the art. In some embodiments, the polycrystalline material 12 may be formed on a supporting substrate 16 (as shown in FIG. 1A) of cemented tungsten carbide or another suitable substrate material in a conventional HTHP process of the type described, by way of non-limiting example, in U.S. Pat. No. 3,745,623 to Wentorf et al. (issued Jul. 17, 1973), or may be formed as a freestanding polycrystalline material 12 (i.e., without the supporting substrate 16) in a similar conventional HTHP process as described, by way of non-limiting example, in U.S. Pat. No. 5,127,923 Bunting et al. (issued Jul. 7, 1992), the disclosure of each of which patents is incorporated herein in its entirety by this reference. In some embodiments, the catalyst material 24 may be supplied from the supporting substrate 16 during an HTHP process used to form the polycrystalline material 12. For example, the substrate 16 may comprise a cobalt-cemented tungsten carbide material. The cobalt of the cobalt-cemented tungsten carbide may serve as the catalyst material 24 during the HTHP process. Furthermore, in some embodiments, the particles 19 also may be supplied from the supporting substrate 16 during an HTHP process used to form the polycrystalline material 12. For example, the substrate 16 may comprise a cobalt-cemented tungsten carbide material that also includes particles 19 therein. The particles 19 of the substrate may sweep into the interstitial spaces between the grains 18 of hard material.

To form the polycrystalline material 12 in an HTHP process, a particulate mixture comprising particles (e.g., grains) of hard material and non-catalytic, non-carbide-forming particles 100 (e.g., nanoparticles 100) may be subjected to elevated temperatures (e.g., temperatures greater than about one thousand degrees Celsius (1,000° C.)) and elevated pressures (e.g., pressures greater than about five gigapascals (5.0 GPa)) to form inter-granular bonds 26 between the particles of hard material and the particles 100, thereby forming the interbonded grains 18 of hard material and the particles 19 of the polycrystalline material 12. In some embodiments, the particulate mixture may be subjected to a pressure greater than about six gigapascals (6.0 GPa) and a temperature greater than about one thousand five hundred degrees Celsius (1,500° C.) in the HTHP process.

Because it may be desirable to keep at least a portion of the particles 19 unreacted with the catalyst material 24, in some embodiments, the polycrystalline material 12 may be formed in more than one HTHP process or cycle wherein each HTHP process has a limited temperature, pressure, and duration. For example, each HTHP process may be for less than about two minutes and at temperatures lower than about 1,500° C. By limiting the duration of the each HTHP process, a diffusion of the catalyst material 24 into the particles 19 may be limited thereby maintaining the integrity of at least a portion of the particles 19.

The particulate mixture may comprise hard particles for forming the grains 18 of hard material previously described herein. The particulate mixture may also comprise at least one of particles of catalyst material 24, and non-catalytic, non-carbide-forming particles (e.g., nanoparticles), such as particles 100 as previously described with reference to FIG. 2 or particles at least substantially comprised of a non-catalytic, non-carbide-forming material for forming the particles 19 in the polycrystalline material 12. In some embodiments, the particulate mixture may comprise a powder-like substance. In other embodiments, however, the particulate mixture may be carried by (e.g., on or in) another material, such as a paper or film, which may be subjected to the HTHP process. An organic binder material also may be included with the particulate mixture to facilitate processing.

Thus, in some embodiments, the non-catalytic, non-carbide-forming particles (e.g., particles 100) may be admixed with the hard particles used to form the grains 18 to form a particulate mixture, which then may be sintered in an HPHT process.

In some embodiments, the non-catalytic, non-carbide-forming particles (e.g., particles 100) may be admixed with the hard particles used to form the grains 18 of hard material prior to a modified HPHT sintering process used to synthesize a nanoparticulate composite that includes the non-catalytic, non-carbide-forming particles and nanoparticles of hard material.

In some embodiments, the non-catalytic, non-carbide-forming particles may be grown on, attached, adhered, or otherwise connected to the hard particles used to form the grains 18 prior to the sintering process. The non-catalytic, non-carbide-forming particles may be attached to the hard particles by functionalizing exterior surfaces of at least one of the non-catalytic, non-carbide-forming particles and the hard particles. After attaching the non-catalytic, non-carbide-forming particles to the hard particles, the resulting particulate mixture may be subjected to an HPHT process to form a polycrystalline material 12 comprising grains of hard material 19 and non-catalytic, non-carbide-forming particles 19, as described above.

In additional embodiments, the non-catalytic, non-carbide-forming particles may be combined with the catalyst material prior to the sintering process. For example, the non-catalytic, non-carbide-forming particles may be grown on, attached, adhered, or otherwise connected to particles of catalyst material, and the coated particles of catalyst material may be combined with hard particles to form the particulate mixture prior to the sintering process. The non-catalytic, non-carbide-forming particles may be attached to the particles of catalyst material by functionalizing exterior surfaces of at least one of the non-catalytic, non-carbide-forming particles and the catalyst particles. After attaching the non-catalytic, non-carbide-forming particles to the catalyst particles and admixing with hard particles, the resulting particulate mixture may be subjected to an HPHT process to form a polycrystalline material 12, as described above.

In some embodiments, the non-catalytic, non-carbide-forming particles may be grown on, attached, adhered, or otherwise connected to both particles of hard material and particles of catalyst material, and the coated particles may be combined to form in the particulate mixture.

As previously mentioned, a particulate mixture that includes hard particles for forming the interbonded grains 18 of hard material, non-catalytic, non-carbide-forming particles, and, optionally, a catalyst material 24 (for catalyzing the formation of inter-granular bonds 26 between the grains 18), may be subjected to an HTHP process to form a polycrystalline material 12. After the HTHP process, catalyst material 24 (e.g., cobalt) and non-catalytic, non-carbide-forming particles 19 may be disposed in at least some of the interstitial spaces 22 between the interbonded grains 18 of hard material.

Optionally, the catalyst material 24 may be removed from the polycrystalline material 12 after the HTHP process using processes known in the art. However, the removal of said catalyst material 24 may also result in the removal of at least a portion of the non-catalytic, non-carbide-forming particles 19, which may be undesirable. For example, a leaching process may be used to remove the catalyst material 24 and/or the non-catalytic, non-carbide-forming particles 19 from the interstitial spaces 22 between the grains 18 of hard material in at least a portion of the polycrystalline material 12. By way of example and not limitation, a portion of the polycrystalline material 12 may be leached using a leaching agent and process such as those described more fully in, for example, U.S. Pat. No. 5,127,923 to Bunting et al. (issued Jul. 7, 1992), and U.S. Pat. No. 4,224,380 to Bovenkerk et al. (issued Sep. 23, 1980), the disclosure of each of which patent is incorporated herein in its entirety by this reference. Specifically, aqua regia (a mixture of concentrated nitric acid ($HNO_3$) and concentrated hydrochloric acid (HCl)) may be used to at least substantially remove catalyst material 24 and/or non-catalytic, non-carbide-forming nanoparticles from the interstitial spaces 22. It is also known to use boiling hydrochloric acid (HCl) and boiling hydrofluoric acid (HF) as leaching agents. One particularly suitable leaching agent is hydrochloric acid (HCl) at a temperature of above one hundred ten degrees Celsius (110° C.), which may be provided in contact with the polycrystalline material 12 for a period of about two (2) hours to about sixty (60) hours, depending upon the size of the body of polycrystalline material 12. After leaching the polycrystalline material 12, the interstitial spaces 22 between the interbonded grains 18 of hard material within the polycrystalline material 12 subjected to the leaching process may be at least substantially free of catalyst material 24 used to catalyze formation of inter-granular bonds 26 between the grains in the polycrystalline material 12. Only a portion of the polycrystalline material 12 may be subjected to the leaching process, or the entire body of the polycrystalline material 12 may be subjected to the leaching process.

In additional embodiments of the present disclosure, non-catalytic, non-carbide-forming particles 19, 100 may be introduced into the interstitial spaces 22 between interbonded grains 18 of hard, polycrystalline material 12 after catalyst material 24 and any other material in the interstitial spaces 22 has been removed from the interstitial spaces (e.g., by a leaching process). For example, after subjecting a polycrystalline material 12 to a leaching process, non-catalytic, non-carbide-forming particles 19, 100 may be introduced into the interstitial spaces 22 between the grains 18 of hard material in the polycrystalline material 12. Non-catalytic, non-carbide-forming particles 19, 100 may be suspended in a liquid (e.g., water or another polar solvent) to form a suspension, and the leached polycrystalline material 12 may be soaked in the suspension to allow the liquid and the non-catalytic, non-carbide-forming particles 19, 100 to infiltrate into the interstitial spaces 22. The liquid (and the non-catalytic, non-carbide-forming particles 19, 100 suspended therein) may be drawn into the interstitial spaces 22 by capillary forces. In some embodiments, pressure may be applied to the liquid to facilitate infiltration of the liquid suspension into the interstitial spaces 22.

After infiltrating the interstitial spaces 22 with the liquid suspension, the polycrystalline material 12 may be dried to remove the liquid from the interstitial spaces, leaving behind the non-catalytic, non-carbide-forming particles 19, 100 therein. Optionally, a thermal treatment process may be used to facilitate the drying process.

The polycrystalline material 12 then may be subjected to a thermal process (e.g., a standard vacuum furnace sintering process) to at least partially sinter the non-catalytic, non-carbide-forming particles 19, 100 within the interstitial spaces 22 in the polycrystalline material 12. Such a process may be carried out below any temperature that might be detrimental to the polycrystalline material 12.

Figure 3:
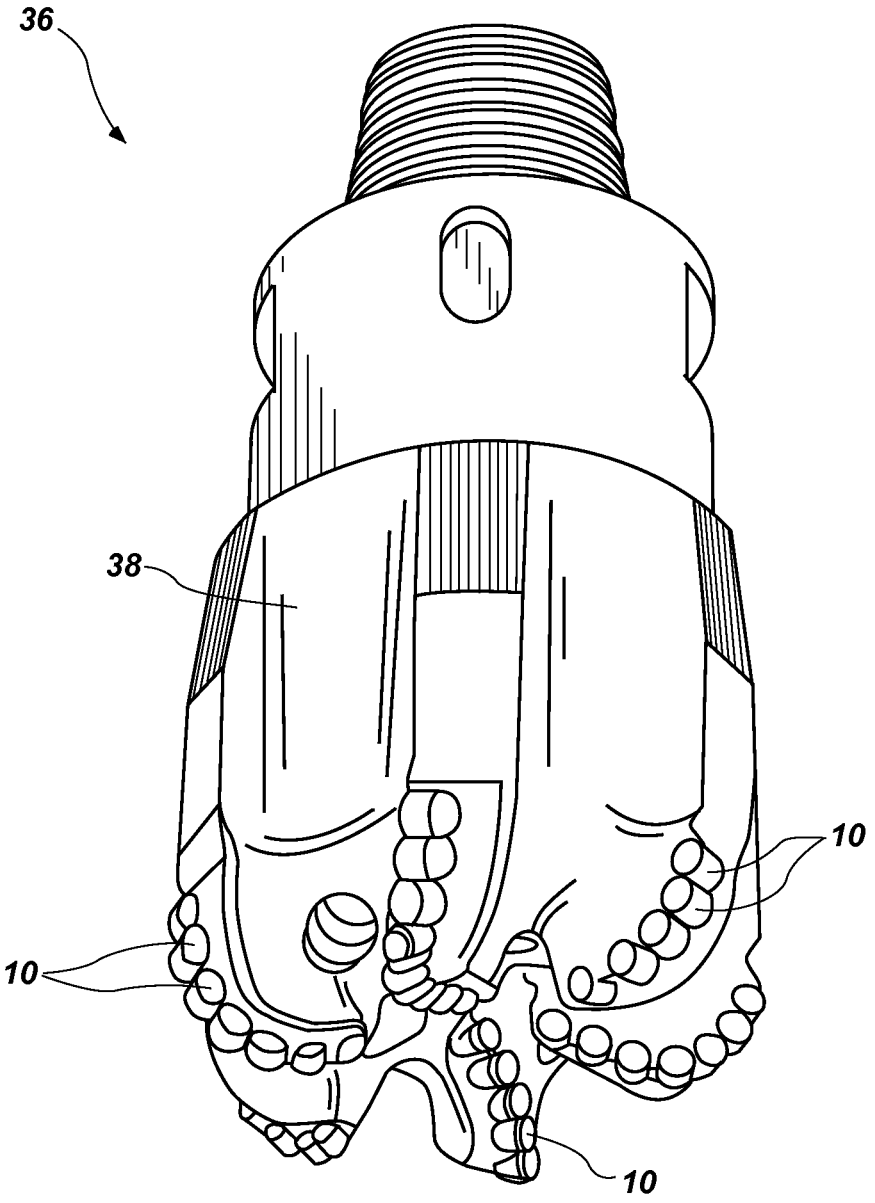
FIG. 3 is a perspective view of an embodiment of a fixed-cutter earth-boring rotary drill bit that includes a plurality of polycrystalline compacts like that shown in FIGS. 1A and 1B.

Embodiments of cutting elements 10 of the present disclosure that include a polycrystalline compact comprising polycrystalline material 12 formed as previously described herein, such as the cutting element 10 illustrated in FIG. 1A, may be formed and secured to an earth-boring tool such as, for example, a rotary drill bit, a percussion bit, a coring bit, an eccentric bit, a reamer tool, a milling tool, etc., for use in forming wellbores in subterranean formations. As a non-limiting example, FIG. 3 illustrates a fixed cutter type earth-boring rotary drill bit 36 that includes a plurality of cutting elements 10, each of which includes a polycrystalline compact comprising polycrystalline material 12 as previously described herein. The rotary drill bit 36 includes a bit body 38, and the cutting elements 10, which include polycrystalline compacts 12, are bonded to the bit body 38. The cutting elements 10 may be brazed (or otherwise secured) within pockets formed in the outer surface of the bit body 38.

In some embodiments, the polycrystalline material 12 may be formed as a multi-portion polycrystalline material as described in, for example, provisional U.S. Patent Application Ser. No. 61/373,617, filed Aug. 13, 2010 and entitled "Cutting Elements Including Nanoparticles in At Least One Portion Thereof, Earth-Boring Tools Including Such Cutting Elements, and Related Methods," the disclosure of which is incorporated herein in its entirety by this reference.

Polycrystalline hard materials that include non-catalytic, non-carbide-forming nanoparticles in interstitial spaces between the interbonded grains of hard material, as described hereinabove, may exhibit improved thermal stability, improved mechanical durability, or both improved thermal stability and improved mechanical durability relative to previously known polycrystalline hard materials. By including the non-catalytic, non-carbide-forming nanoparticles in the interstitial spaces between the interbonded grains of hard material, less catalyst material may be disposed in interstitial spaces between the grains in the ultimate polycrystalline hard material, and the thermal conductivity of the polycrystalline material may be reduced, which may improve one or both of the thermal stability and the mechanical durability of the polycrystalline hard material.

The foregoing description is directed to particular embodiments for the purpose of illustration and explanation. It will be apparent, however, to one skilled in the art that many modifications and changes to the embodiments set forth above are possible without departing from the scope of the embodiments disclosed herein as hereinafter claimed, including legal equivalents. It is intended that the following claims be interpreted to embrace all such modifications and changes.

Additional non-limiting example Embodiments are described below.

Embodiment 1

A polycrystalline compact, comprising: a plurality of grains of hard material, the plurality of grains of hard material being interbonded to form a polycrystalline hard material; and a plurality particles disposed in interstitial spaces between the grains of hard material, the plurality of particles comprising a non-catalytic, non-carbide-forming material.

Embodiment 2

The polycrystalline compact of Embodiment 1, wherein the plurality of grains of hard material comprises grains of diamond.

Embodiment 3

The polycrystalline compact of Embodiment 1 or Embodiment 2, wherein the particles comprise a refractory metal.

Embodiment 4

The polycrystalline compact of Embodiment 1 or Embodiment 2, wherein the particles comprise at least one of rhenium, osmium, ruthenium, rhodium, iridium, and platinum.

Embodiment 5

The polycrystalline compact of any one of Embodiments 1 through 4, further comprising a catalyst material in the interstitial spaces between the grains of hard material.

Embodiment 6

The polycrystalline compact of any one of Embodiments 1 through 5, wherein the particles comprise a material having a lower thermal conductivity than a thermal conductivity of the catalyst material.

Embodiment 7

The polycrystalline compact of Embodiment 5, wherein the particles comprise a material having a lower coefficient of thermal expansion than a coefficient of thermal expansion of the catalyst material.

Embodiment 8

The polycrystalline compact of any one of Embodiment 1 through 7, wherein the particles of the plurality of particles comprise: a core comprising a first material; and at least one coating on the core, the at least one coating comprising a second, different material.

Embodiment 9

The polycrystalline compact of Embodiment 8, wherein the core comprises at least two particles.

Embodiment 10

The polycrystalline compact of Embodiment 8, wherein the core comprises cobalt and the at least one coating on the core comprises rhenium.

Embodiment 11

The polycrystalline compact of Embodiment 8, wherein the at least one coating on the core comprises a first coating comprising rhenium, a second coating comprising platinum, and a third coating comprising rhenium.

Embodiment 12

The polycrystalline compact of any one of Embodiments 1 through 11, wherein the particles of the plurality of particles are about 0.01% to about 50% by volume of the polycrystalline compact.

Embodiment 13

A cutting element, comprising: a substrate; and a polycrystalline compact as recited in any one of Embodiments 1 through 12 on the substrate.

Embodiment 14

An earth-boring tool comprising a polycrystalline compact as recited in any one of Embodiments 1 through 12.

Embodiment 15

The earth-boring tool of Embodiment 14, wherein the earth-boring tool is a fixed-cutter rotary drill bit.

Embodiment 16

A method of forming a polycrystalline compact, comprising sintering a plurality of hard particles and a plurality particles to form a polycrystalline hard material comprising a plurality of interbonded grains of hard material, the particles comprising a non-catalytic, non-carbide-forming material.

Embodiment 17

The method of Embodiment 16, further comprising selecting each the hard particles of the plurality of hard particles to comprise diamond.

Embodiment 18

The method of Embodiment 16 or Embodiment 17, further comprising selecting the particles of the plurality of particles to a refractory metal.

Embodiment 19

The method of Embodiment 16 through 18, further comprising selecting the particles of the plurality of particles to comprise rhenium.

Embodiment 20

The method of any one of Embodiment 16 through 19, further comprising catalyzing the formation of inter-granular bonds between the grains of hard material.

Embodiment 21

The method of any one of Embodiments 16 through 20, wherein sintering a plurality of hard particles and a plurality of particles comprises sintering the plurality of hard particles and the plurality of particles in at least two HTHP processes, each process of the at least two HTHP processes being less than about two minutes in duration.

Embodiment 22

The method of any one of Embodiments 16 through 21, further comprising forming a particle of the plurality of particles comprising: coating a core comprising a first material with a second material, the second material comprising the non-catalytic, non-carbide-forming material.

Embodiment 23

A method of forming a cutting element, comprising infiltrating interstitial spaces between interbonded grains of hard material in a polycrystalline material with a plurality of particles, the particles comprising a non-catalytic, non-carbide-forming material.

Embodiment 24

The method of Embodiment 23, further comprising selecting the grains of hard material to comprise diamond grains.

Embodiment 25

The method of Embodiment 23 or Embodiment 24, further comprising selecting the particles of the plurality of particles to comprise a refractory metal.

Embodiment 26

The method of any one of Embodiments 23 through 25, further comprising selecting the particles of the plurality of particles to comprise at least one of rhenium, osmium, ruthenium, rhodium, iridium, platinum.

What is claimed is:

1. A polycrystalline compact, comprising:

a polycrystalline hard material comprising interbonded grains of hard material;

rhenium-containing particles within interstitial spaces between the interbonded grains of the hard material;

a catalyst material comprising at least one of cobalt, nickel, and iron at least partially surrounding the rhenium-containing particles within at least a portion of the interstitial spaces.

2. The polycrystalline compact of claim 1, wherein the interbonded grains of the hard material comprise interbonded grains of diamond.

3. The polycrystalline compact of claim 1, wherein the rhenium-containing particles comprise rhenium and at least one other refractory metal.

4. The polycrystalline compact of claim 1, wherein the rhenium-containing particles consist essentially of rhenium.

5. The polycrystalline compact of claim 1, wherein the catalyst material comprises cobalt.

6. The polycrystalline compact of claim 1, wherein the rhenium-containing particles comprise at least one material having a lower thermal conductivity than a thermal conductivity of the catalyst material.

7. The polycrystalline compact of claim 1, wherein the rhenium-containing particles comprise at least one material having a lower coefficient of thermal expansion than a coefficient of thermal expansion of the catalyst material.

8. The polycrystalline compact of claim 1, wherein the rhenium-containing particles comprise at least one material having a negative coefficient of thermal expansion.

9. The polycrystalline compact of claim 1, wherein at least one of the rhenium-containing particles comprises:

a core comprising a first material; and a coating comprising rhenium directly on the core.

10. The polycrystalline compact of claim 9, wherein the core comprises at least two particles.

11. The polycrystalline compact of claim 9, wherein the core comprises cobalt.

12. A polycrystalline compact, comprising:

a plurality of grains of hard material, the plurality of grains of the hard material being interbonded to form a polycrystalline hard material; and a plurality particles disposed in interstitial spaces between the grains of the hard material, the plurality of particles comprising:

a core comprising a first material;

a first coating comprising rhenium on the core;

a second coating comprising platinum; and a third coating comprising rhenium.

13. The polycrystalline compact of claim 9, wherein the core comprises at least one of diamond, zirconium tungstate, and scandium tungstate.

14. The polycrystalline compact of claim 1, wherein the particles of the plurality of particles are about 0.01% to about 50% by volume of the polycrystalline compact.

15. A cutting element, comprising:

a substrate; and the polycrystalline compact of claim 1 disposed over the substrate.

16. An earth-boring tool, comprising:

a body; and a plurality of cutting elements carried by the body, wherein at least one cutting element of the plurality of cutting elements comprises the polycrystalline compact of claim 1.

17. A method of forming a polycrystalline compact, comprising:

forming a polycrystalline hard material comprising interbonded grains of hard material, rhenium-containing particles within interstitial spaces between the interbonded grains of the hard material, and a catalyst material comprising at least one of cobalt, nickel, and iron at least partially surrounding the rhenium-containing particles within at least a portion of the interstitial spaces.

18. The method of claim 17, wherein forming a polycrystalline hard material comprises sintering grains of the hard material and the rhenium-containing particles.

19. The method of claim 18, wherein sintering grains of the hard material and the rhenium-containing particles comprises sintering the grains of the hard material and the rhenium-containing particles in at least two HTHP processes, each process of the at least two HTHP processes being less than about two minutes in duration.

20. The method of claim 17, wherein forming a polycrystalline hard material comprises infiltrating the interstitial spaces between the interbonded grains of the hard material with the rhenium-containing particles.

21. The method of claim 17, further comprising selecting each the hard material to comprise diamond.

22. The method of claim 17, further comprising selecting the rhenium-containing particles to comprise rhenium and at least one other a refractory metal.

23. The method of claim 17, further comprising selecting the rhenium-containing particles to consist essentially of rhenium.

24. The method of claim 17, further comprising catalyzing the formation of inter-granular bonds between the interbonded grains of the hard material.

25. The method of claim 17, further comprising forming a coating comprising rhenium directly on a core comprising a first material to form at least one of the rhenium-containing particles.

* * * * *

UNITED STATES PATENT AND TRADEMARK OFFICE

CERTIFICATE OF CORRECTION

PATENT NO. : 8,800,693 B2
APPLICATION NO. : 13/226127
DATED : August 12, 2014
INVENTOR(S) : Anthony A. DiGiovanni It is certified that error appears in the above-identified patent and that said Letters Patent is hereby corrected as shown below:

In the claims:

CLAIM 12, COLUMN 16, LINE 19, change "plurality particles" to --plurality of particles--

Signed and Sealed this
Sixth Day of October, 2015

Michelle K. Lee

Michelle K. Lee
*Director of the United States Patent and Trademark Office*